US007306464B2

(12) United States Patent
Long et al.

(10) Patent No.: US 7,306,464 B2
(45) Date of Patent: Dec. 11, 2007

(54) HAMMER HEAD TRAINING TARGET

(75) Inventors: Raymond J. Long, Plainfield, IL (US); Conrad F. Alfaro, Bolingbrook, IL (US)

(73) Assignee: Long's Striking Tiger Kenpo Karate, Inc., Plainfield, IL (US)

( * ) Notice: Subject to any disclaimer, the term of this patent is extended or adjusted under 35 U.S.C. 154(b) by 279 days.

(21) Appl. No.: 11/101,219

(22) Filed: Apr. 7, 2005

(65) Prior Publication Data

US 2005/0244795 A1 Nov. 3, 2005

Related U.S. Application Data

(60) Provisional application No. 60/562,198, filed on Apr. 14, 2004.

(51) Int. Cl.
*A63B 69/00* (2006.01)

(52) U.S. Cl. ..... 434/247; 482/83

(58) Field of Classification Search ..... 434/247, 434/257, 258; 482/83, 84, 86, 87, 88; 2/18
See application file for complete search history.

(56) References Cited

U.S. PATENT DOCUMENTS

| | | | | |
|---|---|---|---|---|
| 421,447 | A * | 2/1890 | Stewart | 2/18 |
| 3,185,476 | A * | 5/1965 | Fechner | 473/596 |
| 3,755,820 | A | 9/1973 | Petrusek | |
| 3,855,633 | A | 12/1974 | Rhee | |
| 3,896,497 | A * | 7/1975 | Rhee | 2/20 |
| 3,933,354 | A | 1/1976 | Goldfarb et al. | |
| 4,088,315 | A | 5/1978 | Schemmel | |
| 4,309,029 | A | 1/1982 | Tomko | |
| 4,401,303 | A | 8/1983 | Anderson et al. | |
| 4,478,408 | A | 10/1984 | Bruckner | |

(Continued)

FOREIGN PATENT DOCUMENTS

| | | |
|---|---|---|
| CA | 1 203 258 | 4/1986 |

(Continued)

OTHER PUBLICATIONS

PCT International Search Report, PCT/US2005/011672; Dated Jun. 20, 2005; 3 Sheets.

(Continued)

*Primary Examiner*—Kurt Fernstrom
(74) *Attorney, Agent, or Firm*—Welsh & Katz, Ltd.

(57) ABSTRACT

A hammer head training target for enhancing the level of training by training realistically and effectively with a life-like target head. The inventive device includes a life-like resilient foam head having an integral oval-shaped handle and a core insert clamshell encasing that traps the handle in place. The head resembles the head of a human being with eye, ear, nose, mouth and temple features. An opening is provided in the back side of the head for access to the handle. The handle is oval in shape and is strategically located at the centroid of the head for optimum angle position for the trainer's hand. The handle is sandwich between the left-hand and the right-hand core insert encasings. The left-hand core insert captivates half of the handle structure. It contains half of the enclosure for protecting the hand during training. The right-hand core insert captivates half of the handle structure. It contains half of the enclosure for protecting the hand during training.

7 Claims, 5 Drawing Sheets

U.S. PATENT DOCUMENTS

| | | | | | |
|---|---|---|---|---|---|
| D277,592 | S | | 2/1985 | Jackson | |
| 4,974,833 | A | * | 12/1990 | Hartman et al. | 482/3 |
| 4,991,231 | A | * | 2/1991 | Swift | 2/18 |
| 5,221,243 | A | * | 6/1993 | Walker | 482/83 |
| 5,302,165 | A | * | 4/1994 | Caruthers | 482/108 |
| 5,330,403 | A | | 7/1994 | Kuo | |
| 5,605,336 | A | * | 2/1997 | Gaoiran et al. | 273/445 |
| 5,624,358 | A | | 4/1997 | Hestilow | |
| 5,716,302 | A | | 2/1998 | Andersson | |
| 5,792,032 | A | | 8/1998 | Williams et al. | |
| D515,652 | S | * | 2/2006 | McCreath | D21/798 |

FOREIGN PATENT DOCUMENTS

| | | |
|---|---|---|
| FR | 2 788 990 | 2/1999 |
| WO | WO 02/056970 A2 | 7/2002 |
| WO | WO 02/056970 A3 | 7/2002 |

OTHER PUBLICATIONS

PCT Written Opinion of the International Searching Authority; Dated Jun. 20, 2005; 5 Sheets.

* cited by examiner

HAMMER HEAD TRAINING TARGET

RELATED APPLICATIONS

This application is related to, but not dependent upon, application Ser. No. 60/562,198, filed Apr. 14, 2004 for Hammer Head Training Target, assigned to the assignee of the present invention.

FIELD OF INVENTION

The present invention generally relates to a training target and, more specifically, to a hammer head training target for enhancing the level of training by training realistically and effectively with a life-like target head.

BACKGROUND OF THE INVENTION

It can be appreciated that training targets have been in use for years. Typically, a training target comprises target pads that are shaped to resemble a human head, and that are worn over the hand in an open-palm position during practice. Another variation of a target pad is mounted on the hand with dual contraptions for strapping the hand, and with a pocket for receiving the fingers. Another variation of a target pad is a device that is mounted on the hand with the fingers in a fist-like position. Another variation of a target pad is a mechanical target pad that is mounted on the wall for target practice. Another variation of a target pad is an exercise device that includes a target section having the shape of the head, neck and torso of a human. Another variation of a target pad resembles a life-like striking dummy as an attachment to a punching bag.

The main problem with conventional training targets is that the target pad is not safely secured during practice because the trainer's hand is inserted in the target head in the open-palm position. The same issue applies with a similar device wherein the hand assumes the fist position when inserted in the target pad prior to use. Both devices are susceptible to a complete separation of the target pads from the hand during target practice, thus exposing the trainer's hand to potential injury.

Another problem with conventional training targets is that it takes a long time to use the target pad for practice because the target requires a contraption to captivate the hand and fingers prior to practicing. Another problem with conventional training target are the target pads are heavy, expensive and not easy to use and to setup for target practice.

The following are examples of prior art patent documents that disclose various types of training devices. U.S. Pat. No. 4,991,231 discloses a karate target pad. The abstract of this patent states that the target pad is worn on the hand and wrist. The patent teaches that the user's hand is held in an open palm position. The content of the '231 patent is incorporated by reference as if fully set forth herein.

U.S. Pat. No. 3,855,633 discloses a karate glove. The abstract of this patent states that the glove comprises a tough outer casing with resilient foam means disposed therein. The content of this patent is incorporated by reference as if fully set forth herein.

U.S. Pat. No. 4,478,408 discloses a hand and forearm protective device for the interception of thrusts in martial arts. The abstract of the patent states that the device includes a polyurethane foam mitt having a parallelepiped basic body. The content of this patent is incorporated by reference as if fully set forth herein.

U.S. Pat. No. 3,755,820 discloses an inflatable boxing glove or pillow. The abstract of the patent states that the glove includes a casing having an axially disposed open ended tubular sleeve. The content of this patent is incorporated by reference as if fully set forth herein.

U.S. Design Pat. No. D277,592 discloses karate kick training target. The content of this patent is incorporated by reference as if fully set forth herein.

U.S. Pat. No. 4,309,029 discloses a martial arts striking machine. The abstract of the patent states that the device includes a base and at least two supports of differing heights. The content of this patent is incorporated by reference as if fully set forth herein.

BRIEF DESCRIPTION OF THE DRAWINGS

Various examples objects, features and attendant advantages of the present invention will become fully appreciated as the same becomes better understood when considered in conjunction with the accompanying drawings, in which like reference characters designate the same or similar parts throughout the several views, and wherein:

FIG. 10 A is a sectional view of a further exemplary embodiment of a hammer head training target in accordance with the present invention.

DETAILED DESCRIPTION OF THE INVENTION

Figure 1:
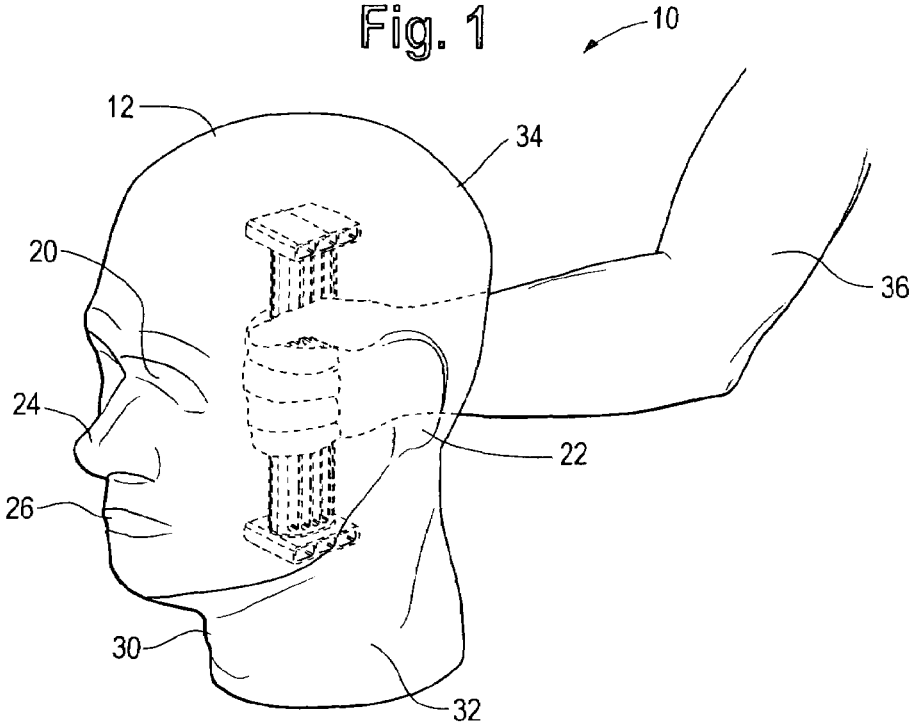
FIG. 1 is a perspective view of an exemplary embodiment of a hammer head training target 10 that incorporates the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated. It should be further understood that the title of this section of this specification, namely, "Detailed Description Of The Invention", relates to a requirement of the United States Patent Office, and does not imply, nor should be inferred to limit the subject matter disclosed herein.

In the present disclosure, the words "a" or "an" are to be taken to include both the singular and the plural. Conversely, any reference to plural items shall, where appropriate, include the singular.

The hammer head training target according to the present invention substantially departs from the conventional concepts and designs of the prior art and in so doing, provides an apparatus primarily developed for the purpose of enhancing the level of training by training realistically and effectively with a life-like target head. The present invention provides a new hammer head training target construction wherein the same can be utilized for enhancing the level of training by training realistically and effectively with a life-like target head.

An exemplary embodiment of the present invention is generally discussed in the remainder of this paragraph. A life-like resilient foam head is positioned or formed on a clamshell designed core insert that encases and traps a handle in place. The head resembles the head of a human being with eye, ear, nose, mouth and temple features. An opening is provided in the back side of the head for access to the handle. The handle may, for example, be oval in shape, and may be strategically located at the centroid of the head for optimum angle position for the trainer's hand. The handle is sandwiched between left-hand and the right-hand core insert encasings.

A primary object of the present invention is to provide a hammer head training target that will overcome the shortcomings of the prior art devices.

An object of the present invention is to provide a hammer head training target for enhancing the level of training by training realistically and effectively with a life-like target head.

Another object is to provide a hammer head training target that can be used to train effectively with realistic target.

Another object is to provide a hammer head training target that improves visual and reaction time during training.

Another object is to provide a hammer head training target that develops weapons quickly with realistic targets. Weapons include punch, heel palm and ridge palm. The target includes ears, jaw hinge, temple, nose, eyes, chin, throat and head.

Another object is to provide a hammer head training target that provides great training tool for correcting methods of delivering hits to key targets.

Another object is to provide a hammer head training target that is ideal for developing strengths and postures.

Another object is to provide a hammer head training target that is safe. The device offers unsurpassed quality and longevity with it's durable urethane foam material on the exterior coupled with an engineering thermoplastic core insert encasing completely protecting the hand during practice blows. The head material has a durometer or hardness that is engineered for optimum performance.

Another object is to provide a hammer head training target that is easy to use and is secured during practice. This is accomplished by, for example, using an integral handgrip with, for example, an oval shape configuration to ensure a secure grip for the trainer's hand.

Other objects and advantages of the present invention will become obvious to the reader and it is intended that these objects and advantages are within the scope of the present invention.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

Figure 2:
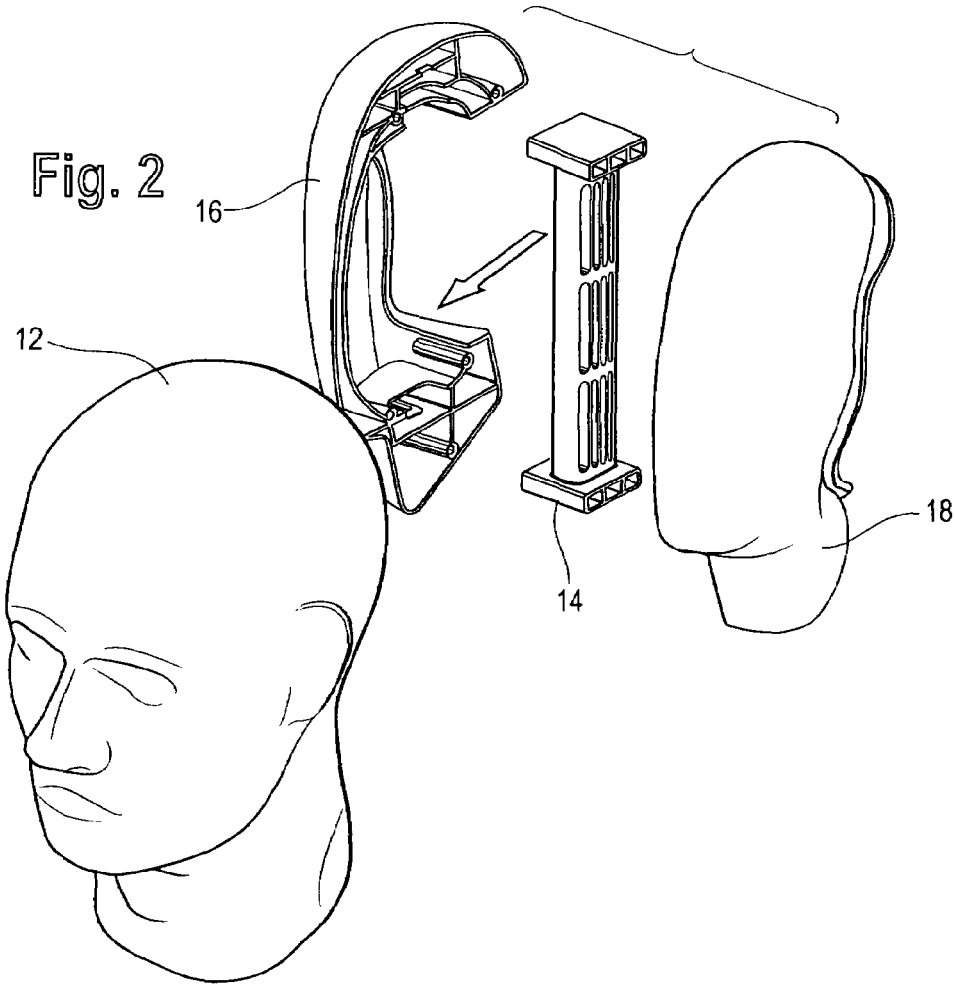
FIG. 2 is an exploded view of the hammer head training target shown in FIG. 1 in which all of its constituent components are illustrated.
Figure 3:
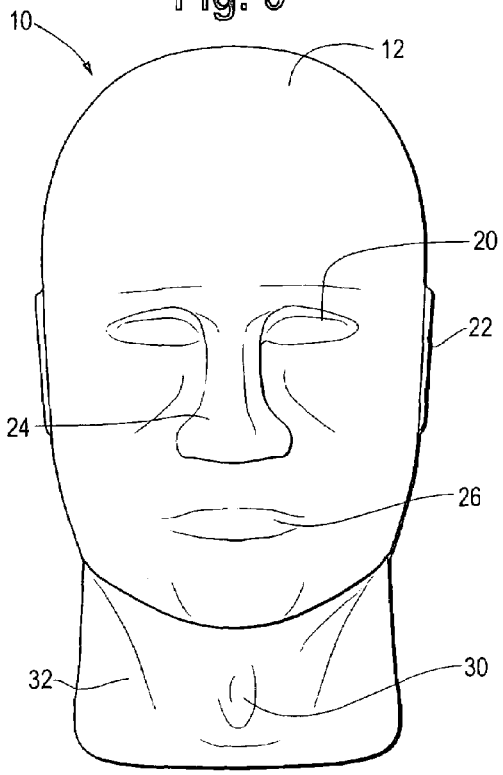
FIGS. 3 and 4 are front and rear views of the hammer head training target shown in FIG. 1.

Turning now descriptively to the drawings, similar reference characters are used to denote similar elements throughout all of the Figures. Referring specifically to FIGS. 1 and 2, a hammer head training target 10 is illustrated. In accordance with the exemplary embodiment shown, target 10 comprises a life-like resilient foam head 12 having an integral handle 14, a right hand core insert 16, and a left hand core insert 18. The core inserts 16 and 18 form a clamshell shape that encases and that traps the handle 14 in place.

The head 12 resembles the head of a human being. In this regard, head 12 is provided with eye features 20, ear features 22, a nose feature 24, a mouth feature 26, a temple feature 28, an adam's apple feature 30, and a neck feature 32. An opening 34 is provided in the back side of the head 12 so that a user of target 10 can readily insert his or her hand 36 into the opening 34 and grasp the handle 14.

The handle 14 is, for example, oval in shape. The handle 14 also is, for example, strategically located at the centroid of the head 12 for optimum angle position for the trainer's hand. The handle 14 is sandwiched between the left-hand and the right-hand core insert encasings 16 and 18. The right-hand core insert 16 captivates half of the handle structure. It contains half of the enclosure for protecting the hand during training. The left-hand core insert 18 captivates half of the handle structure. It contains half of the enclosure for protecting the hand during training.

The head 12 is made out of, for example, specially formulated polyurethane material with a durometer engineered for optimum hardness, thus making the device suitable for training. The head 12 completely surrounds a core insert assembly, which comprises of a left-hand and right-hand inserts 16 and 18, and a handle 14. In the embodiment of the invention shown in FIG. 1, an adult sized head is shown. However, the present invention is not limited to any particular size of head. For example, a kid-size version of the head is another variation of a hammer head training target that is within the scope of the present invention.

Figure 4:
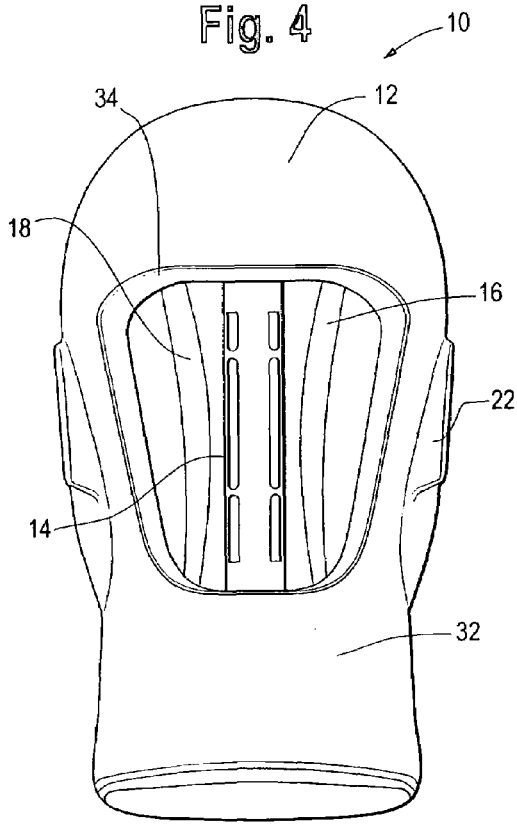
Figure 5:
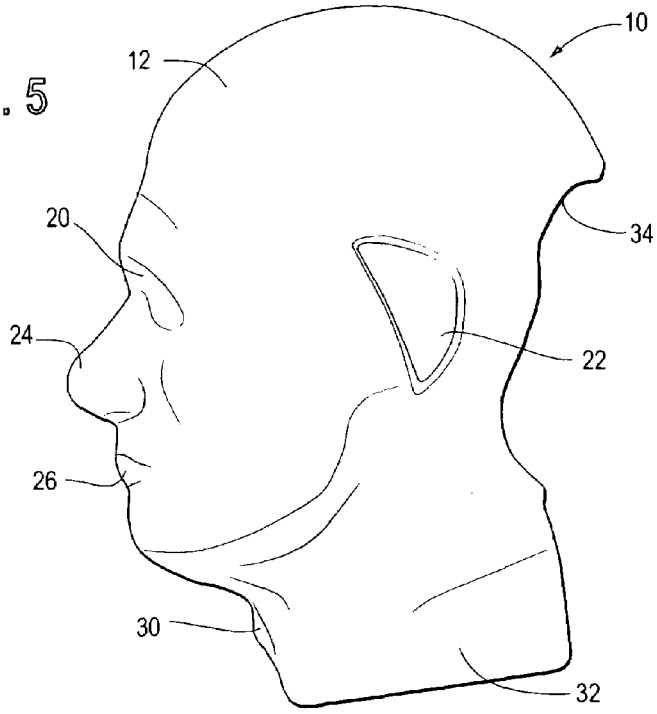
FIG. 5 is a side view of the hammer head training target shown in FIG. 1 with the operator's hand removed.
Figure 6:
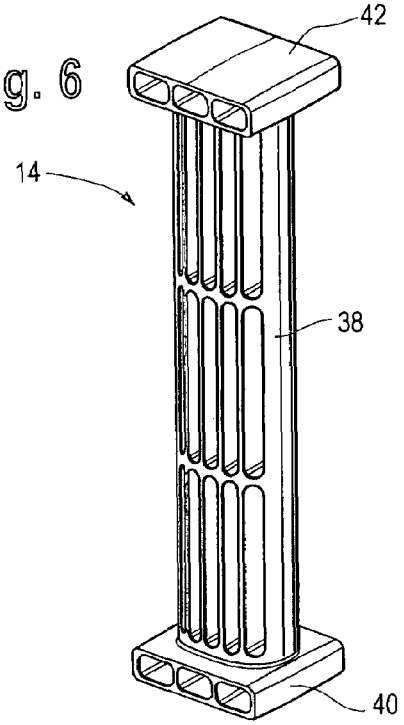
FIG. 6 is a perspective view of the handle shown in FIG. 2.
Figure 7:
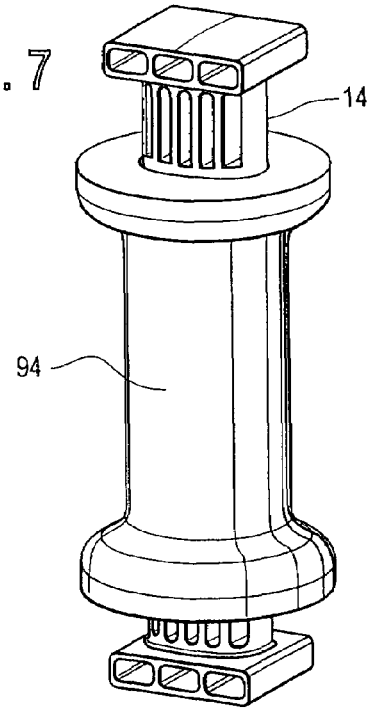
FIG. 7 is a perspective view of an alternate embodiment for the handle shown in FIG. 2.

Referring to FIG. 6, a close-up, perspective view of handle 14 is shown. The handle 14 is, for example, a molded plastic part, and includes, for example, an oval handgrip 38. The handgrip 38 can, for example, be provided with cored-out molded feature as shown. An alternate embodiment of the handle 14, which shows a cushion handle 94 wrapped around handle 14, is shown in FIG. 7. The handle is symmetrically located within the opening of 34 as, for example, shown in FIG. 4. As shown in FIG. 6, handle member 50 also includes end portions 40 and 42, both of which include three apertures 44 that cooperate with the operative portions on the right and left hand inserts 16 and 18 to trap the handle 12 between the core inserts 16 and 18 as discussed in greater detail hereinafter.

Figure 9:
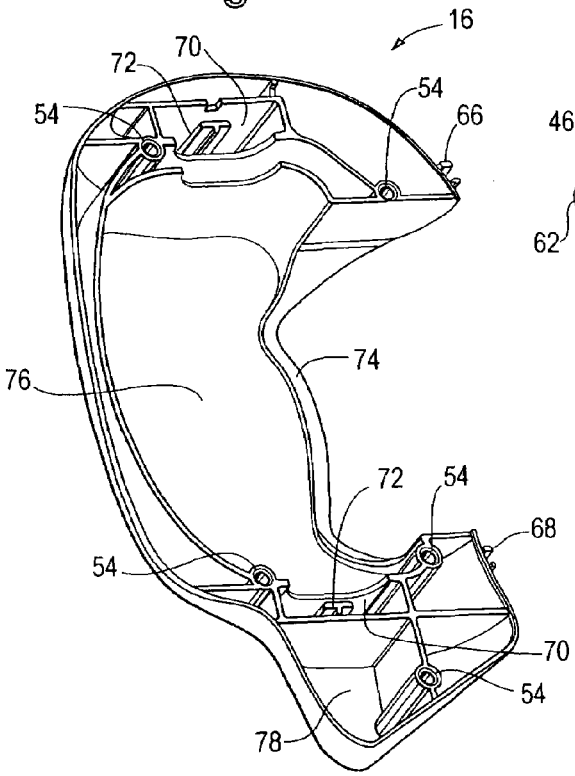
FIGS. 8 and 9 are close-up views of the first and second core inserts shown in FIG. 2.
Figure 8:
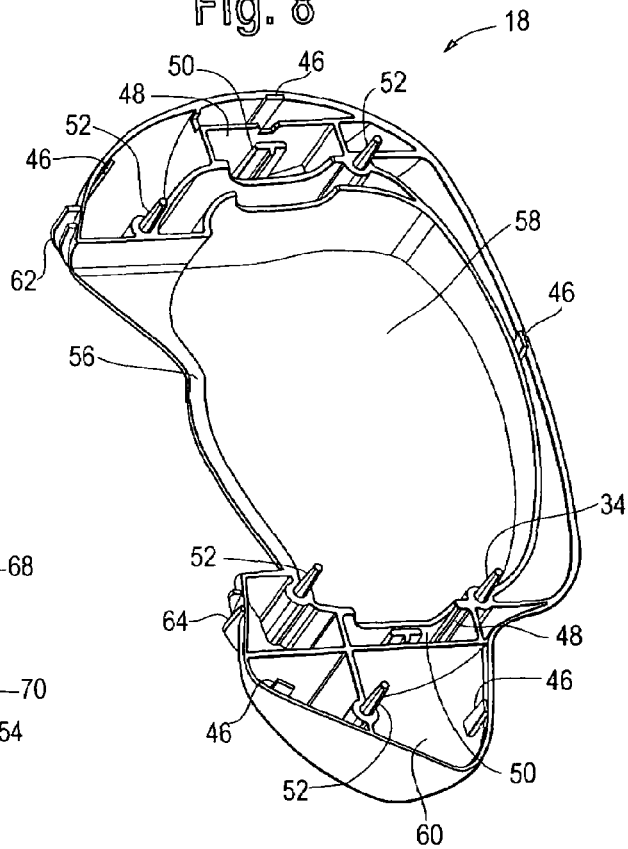

The left-hand core insert 18 captivates half of the handle structure. It contains half of the enclosure for protecting the hand during training. Referring to FIG. 8, a perspective view of the left-hand core insert 18 is shown. Insert 18 is, for example, a molded plastic part, and includes five anti-collapsed vertical walls 46, and two mating features 48 that have a tongue member 50 centrally disposed therein. The end portions 40 and 42 of the handle 14 are adapted to be inserted into the mating features 48, with the tongue members 50 being received within a corresponding opening formed within the handle end portions 40 and 42. Core insert 18 also includes, for example, five pins 52 that are adapted to be inserted in five holes 54 that are defined in the right hand core insert 16 (FIG. 9). Core insert 18 also includes a hand protector 56, a knuckle area 58, and a neck extender 60.

Anti-separation features 62 and 64 are molded on core insert 18, and are intended to be mated with projections 66 and 68 on core insert 16 (FIG. 9).

The right-hand core insert 16 shown in FIG. 9 captivates half of the handle structure. It contains half of the enclosure for protecting the hand during training. The right-hand core insert 16 is a molded plastic part, and includes two mating features 70 that have a tongue member 72 centrally disposed therein. The end portions 40 and 42 of the handle 14 are adapted to be inserted into the mating features 70, with the tongue members 72 being received within a corresponding opening formed within the handle end portions 40 and 42. Core insert 16 also includes a hand protector 74, knuckle area 76, and neck extender 78.

The hammer head training target 10 may be manufactured, for example, as follows. First, the handle 14 and core inserts 16 and 18 are formed via, for example, an appropriate molding process. After these parts are formed, the handle 14 is firmly pressed onto the opening cavity of left-hand core insert 18 so that the handle end portions 40 and 42 are received within the mating feature 48 of core insert 18. Then, the right-hand core insert 16 is assembled onto the left-hand core insert 18 while the handle 14 is in place. The pins 52 and holes 54 on core insert 16 are sized so that the core inserts 16 and 18 are held together via a resistance fit. The anti-separation features 62 and 64 cooperation with the projections 66 and 68 also serve to hold the core inserts 16 and 18 together.

Figure 10:
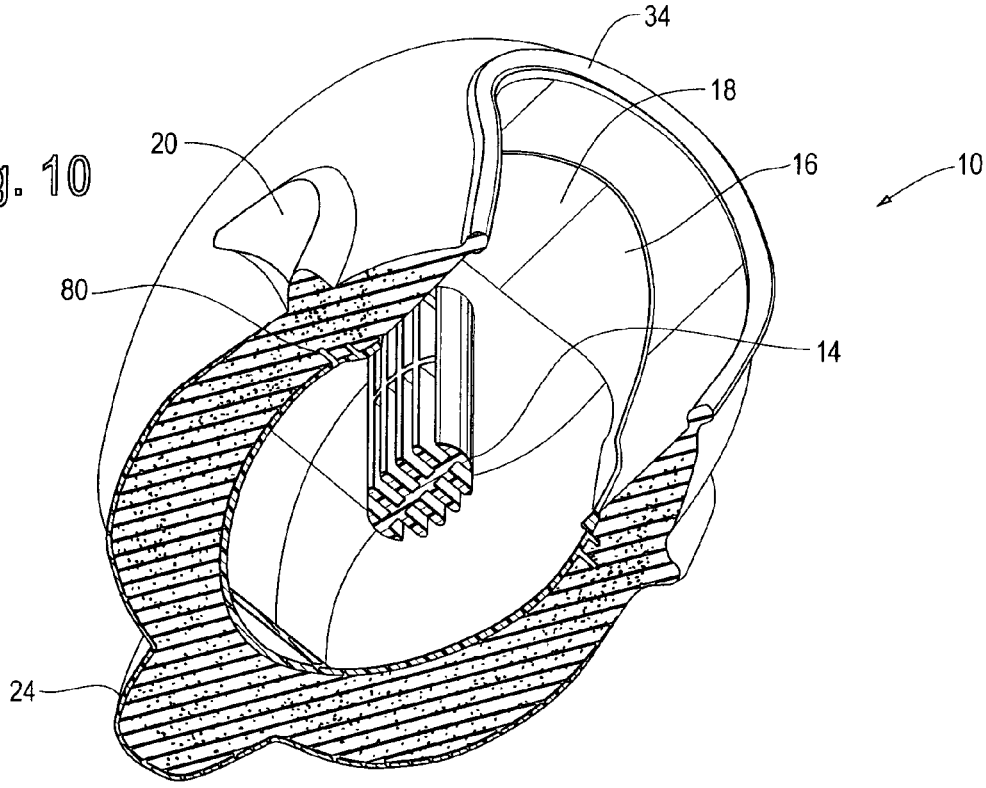
FIG. 10 is a sectional view of the hammer head training target shown in FIG. 1.
Figure 10A:
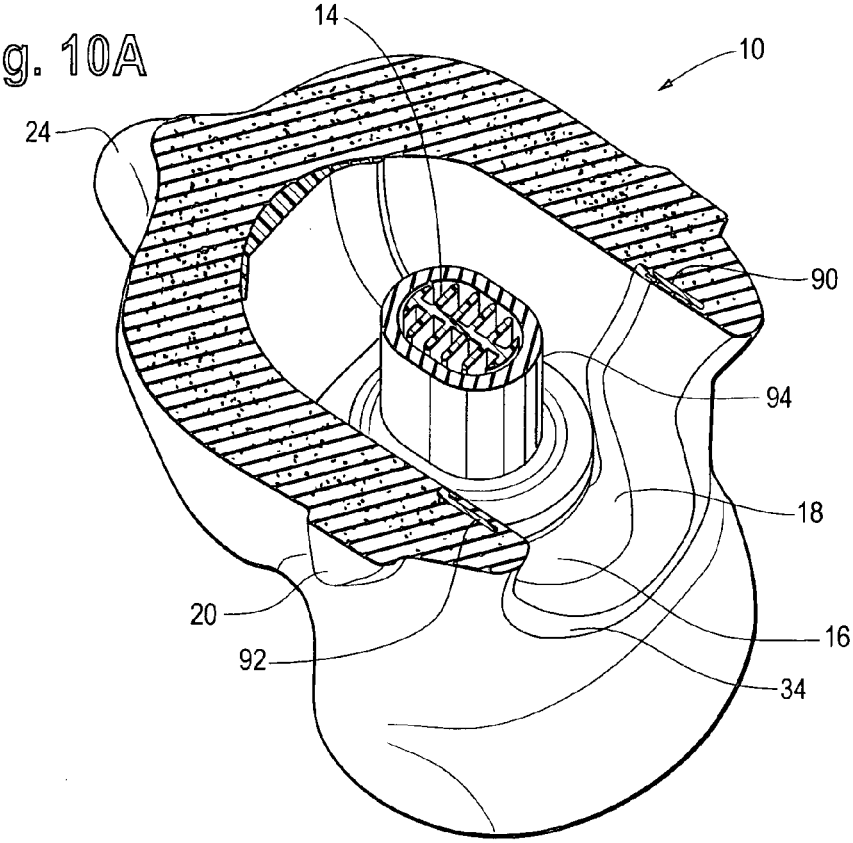

After these operations, the assembly is prepared for a secondary foam molding operation. A shut-off tool part (not shown) is inserted into opening 34 up to the handle 14. The tool is used to shut-off foam away from the core. FIG. 10 is a cross-sectional view of the hammer head training target 10 with the core inserts 16 and 18 being surrounded by an appropriate foam material. The foam 10 takes the shape of the human head. Item 70 shows the knuckle-hand area available for the trainer's hand. Item 80 shows the anchoring point for the foam.

Benefits of Hammer Head includes, but not limited to the following: train effectively with realistic targets, improve visual and reaction during training, develop punch, heel palm and ridge hand weapons quicker with realistic targets such as: ears, jaw hinge, temple, nose, eyes, chin, throat and head, great training tools for correcting methods to deliver hits to key targets, ideal for developing strengths and postures, mobile product for easy transport, fun to hit, available in multitude of colors, holder's hand fully protected during training and handheld, wall mounted and ceiling mounted versions are available. Hammer Head guarantees improvements in accuracy by providing realistic targets in various parts of the head. It is an ideal life-like head target for developing punch, heel palm and ridge hand weapons. With the new Hammer Head, training is now more fun and enjoyable because you now have a realistic target to hit. This new target training Hammer Head offers unsurpassed quality and longevity with it's durable dense compressed foam material on the outside core coupled with a high-impact flexible material on the inside core.

The hammer head training target 10 can include various optional features. A wall-mount version of the Hammer Head training target can be achieved by replacing the handle with a similar handle design that has a contraption for mechanically attaching it to the wall. Alternatively, a fastening device can be located on the top and bottom of the head. The fastening device is used to mount an external string from the head to the ceiling for use with "focus training".

As an additional example, the hammer head training device 10 can be modified to include bruising effect on the head so that, every time the head takes a blow, it shows the location of the hit via a simulated "bruising". The bruising is accomplished using a specially formulated polyurethane material that changes color when the head is hit with a punch. Simultaneously after a punch is applied onto the head, the area of contact will cave in and eventually will revert to its original form over a pre-calibrated time. The key to this bruising feature lies in the formulation of the material. This information will be used to size up the trainee's level of accuracy.

Hammer head target 10 can be provided with, for example, a piezo-electric device and other appropriate electronic elements to detect, measure and display the force of blows received by the target 10 when used. In one example, an LCD display is mounted on the back of the head 12. Alternatively, appropriate communications circuitry can be included in the target 10 so that the signals generated from the piezo-electric device can be wirelessly routed over to a base station computer. Well known database and graphing programs on the base station computer can be used to, for example, record the force of blows over time for a particular student or a group of students. This will allow, for example, a teacher to monitor the progress of the student(s) over time.

Figure 11:
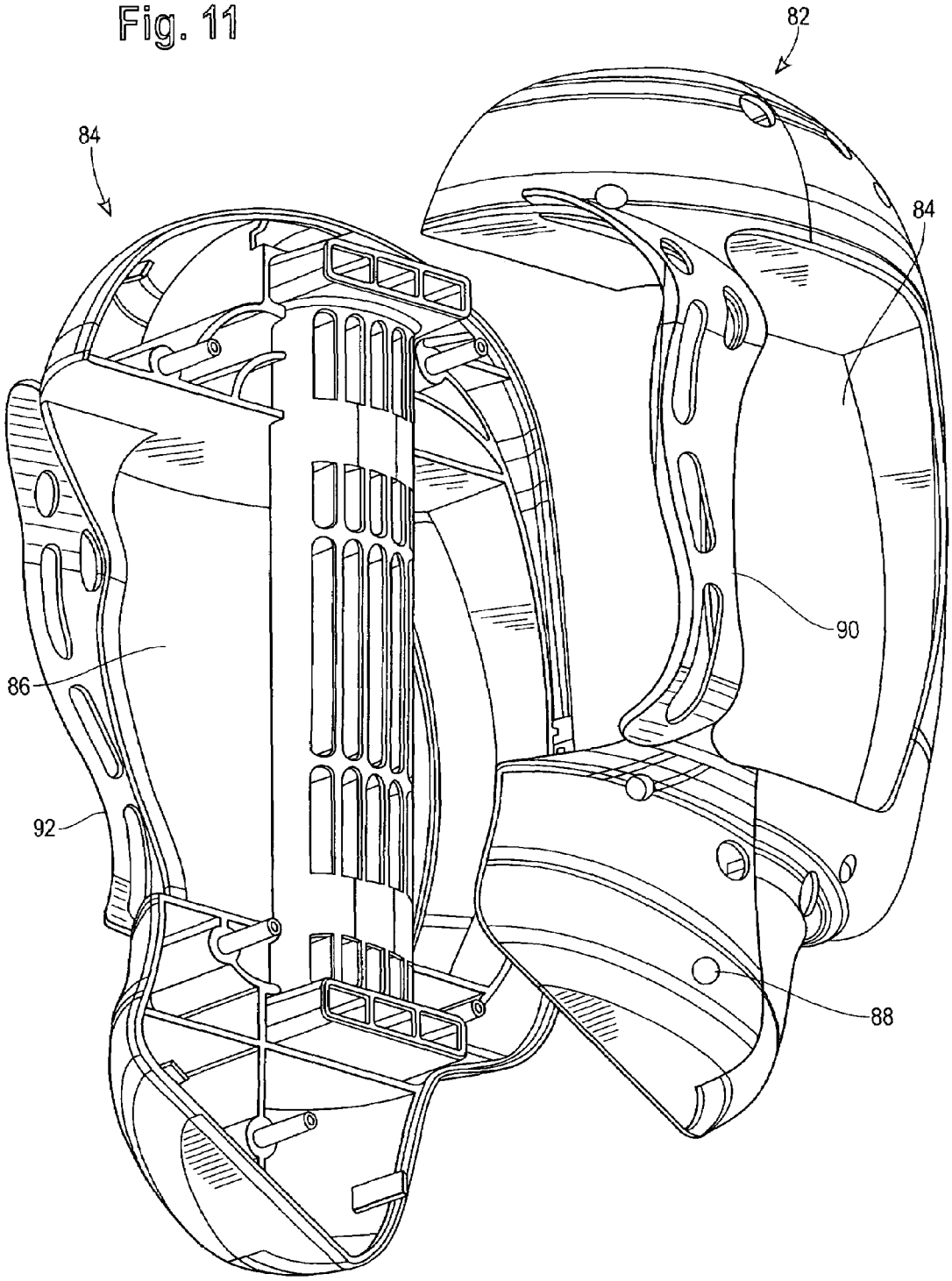
FIG. 11 is an exploded view of a core assembly, similar to that shown in FIG. 2, which includes exemplary modifications to the two core inserts shown.

Referring to FIG. 11, an exploded view of a core assembly, similar to that shown in FIG. 2, is shown which includes exemplary modifications to the two core inserts. The core inserts 16 and 18 shown in FIG. 2 include solid sides, and are formed from a material that is significantly less flexible than that of the material from which head 12 is formed. In order to provide an increased "shock absorber" effect when a target receives a blow from the side, the core inserts 82 and 84 are provided with openings 84 and 86 on their sides. This allows, for example, the flexion of the head 12 to be increased when a target receives a blow from the side without reducing any of the structural integrity of the hammer head training target. The core inserts 16 and 18 shown in FIG. 8 and 9 include an anti-separation feature 62, 64, 66 and 68. In order to maximize the foam grip onto core inserts 16 and 18, the inserts are provided with alternate anchors 88 (a total of 8 anchors per insert) and hand protector anchor bands 90 and 92.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A hammer head training target, comprising:

first and second core inserts that are affixed together and that have the general shape of a human head;

a handle sandwiched between and rigidly held in place by the first and second core inserts, the handle and the first and second core inserts being formed from a hard and generally non-resilient thermoplastic material;

wherein the handle and the first and second core inserts are arranged with respect to each other to provide a user with a multi-position hand grip or a two-handed non-slip grip, and to allow a holder of the hammer head training target to control it in multiple positions even after it is struck by a hitter;

an outer shell disposed on an outer surface of the first and second core inserts, the outer shell, when struck by a hitter, gives the hitter the impression that the hitter is striking a human head; and wherein the outer shell is formed by a foam molding process, the foam flowing into and around the first and second core inserts to lock the first and second core inserts together with the handle being sandwiched therebetween.

2. The hammer head training target of claim 1, further comprising complementary mating features are formed on the handle and the first and second core inserts.

3. The hammer head training target of claim 1, wherein to handle is disposed at a centroid of to first and second con inserts.

4. The hammer head training target of claim 1, wherein to outer shell is formed from polyurethane.

5. The hammer head training target of claim 1, wherein to first core insert includes a plurality of pins that are adapted to be received within complementary holes that are formed in the second core insert.

6. The hammer head training target of claim 5, wherein to plurality of pins on to first core insert are interference fitted within to complementary holes of to second core insert.

7. The hammer head training target of claim 1, further comprising a sensor and a display that are adapted to provide a visual indication of to force applied by a hitter to the outer shell.

* * * * *